United States Patent [19]

Jost et al.

[11] 3,968,380

[45] July 6, 1976

[54] HIGH GAIN RELAYS AND SYSTEMS

[75] Inventors: Ernest M. Jost, Plainville; Lyle E. McBride, Jr., Norton; Teuvo J. Santala, Attleboro, all of Mass.

[73] Assignee: Texas Instruments Incorporated, Dallas, Tex.

[22] Filed: Jan. 7, 1974

[21] Appl. No.: 431,539

Related U.S. Application Data

[62] Division of Ser. No. 351,683, April 16, 1973, Pat. No. 3,893,055.

[52] U.S. Cl. ..... 307/99; 337/140

[51] Int. Cl.[2] ..... H01H 47/02

[58] Field of Search ..... 307/99; 337/140; 333/32, 35; 317/157, 156 TR; 219/501, 504, 505, 499

[56] References Cited

UNITED STATES PATENTS

| | | | |
|---|---|---|---|
| 3,374,337 | 3/1968 | Barley | 219/499 |
| 3,417,228 | 12/1968 | Little | 219/505 |
| 3,516,082 | 6/1970 | Cooper | 337/140 |
| 3,554,680 | 1/1971 | Malavasi | 431/78 |
| 3,665,159 | 5/1972 | Becker et al. | 219/497 |
| 3,718,924 | 2/1973 | Trybert et al. | 219/499 |
| 3,745,308 | 7/1973 | Lefferts | 219/501 |
| 3,752,956 | 8/1973 | Cahill et al. | 219/505 |

*Primary Examiner*—David Smith, Jr.
*Attorney, Agent, or Firm*—John A. Haug; James P. McAndrews; Russell E. Baumann

[57] ABSTRACT

The disclosure relates to high gain electrical relays which are operable at very low power levels and which, when arranged in a relay system with impedance matching to an energizing power source, are operable at the low power levels used in energizing integrated circuits. The relays utilize nickel-titanium alloy wires which are conditioned and arranged to display sharp, reversible changes in shape and modulus of elasticity as the wires are heated and cooled through a temperature transition range, the alloy wires being disposed, preferably with impedance matching means between the wires and energizing power sources, to be heated through the noted transition temperature range by directing current from such low power sources through the wires, thereby to initiate relay operation. The relay construction provides unusually high gain so that relay operation from such low power sources is effective for regulating operation of various types of components used in electrical apparatus.

11 Claims, 17 Drawing Figures

HIGH GAIN RELAYS AND SYSTEMS

This is a division of application Ser. No. 351,683, filed Apr. 16, 1973, now U.S. Pat. No. 3,893,055.

Various types of electrical apparatus could be provided with compact and inexpensive but highly sophisticated control systems through the use of integrated circuits which incorporate a number of circuit elements in a single integrated circuit chip. However, because such integrated circuits are conventionally operated at very low power levels, integrated circuit control systems as previously contemplated would often be effective in regulating such apparatus only where the control systems were provided with many additional and expensive circuit elements for amplifying control signals and for supplying the additional power required to operate the relatively large relays which have been conventionally used in regulating the operation of various components in such electrical apparatus.

It is an object of this invention to provide novel and improved electrical relays and relay systems; to provide such relays which are operable at very low power levels; to provide such relays which, when impedance matched to an energizing power source, are operable at the power levels used in energizing integrated circuits; to provide such relays and relay systems which display unusually high gain; to provide such relays which are operable at such low power levels but which display sufficiently high gain for economically regulating operation of a variety of electrical components in conventional electrical apparatus; to provide corresponding control devices of various types which are operable at such low power levels; and to provide such relays and devices which are of simple, economical and reliable construction.

Briefly described, the novel and improved relay of this invention employs a wire of a nickel-titanium alloy which has been conditioned and arranged so that the wire displays a sharp but reversible change in length and a sharp or abrupt increase in modulus of elasticity as the wire is heated to a relatively low transition temperature. The wire is provided with significant length and with a very fine cross-sectional size and is arranged within the relay so that wire is adapted to be heated to its transition temperature with a very small input of electrical energy and so that, as the wire is heated to its transition temperature, the wire is adapted to display its change of length and increase in modulus of elasticity and to apply a very substantial force and motion to a switching element, thereby to achieve unusually high gain to effect switching of sufficient power for economically regulating operation of various types of components in an electrical apparatus. In preferred embodiments of the invention, the high gain relay is combined with means matching the impedance of the fine alloy wire to a low power source such as is used in energizing integrated circuits.

Other objects, advantages and details of construction of the high gain relays and systems of this invention appear in the following detailed description of preferred embodiments of the invention, the detailed description referring to the drawings in which.

Figure 7:
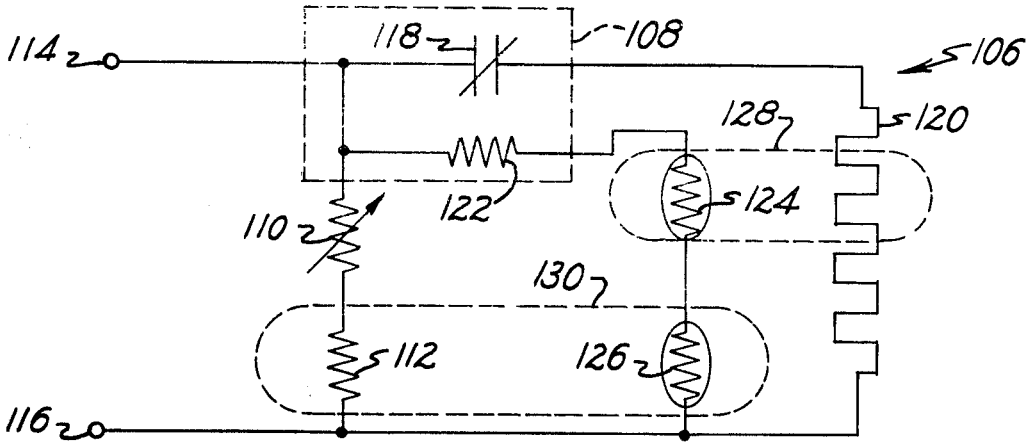
FIG. 7 is a schematic diagram illustrating use of the relay of this invention as a relay system of this invention.
Figure 15:
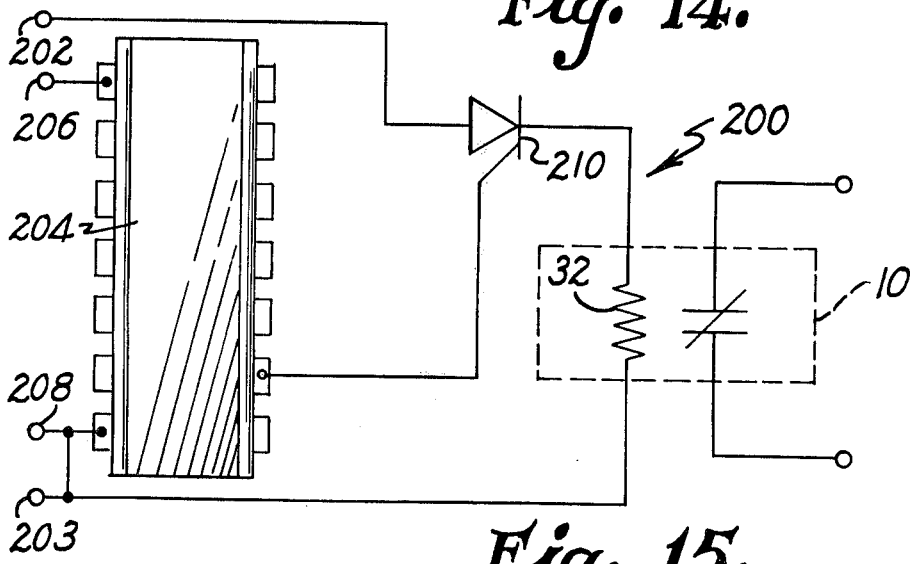
Figure 16:
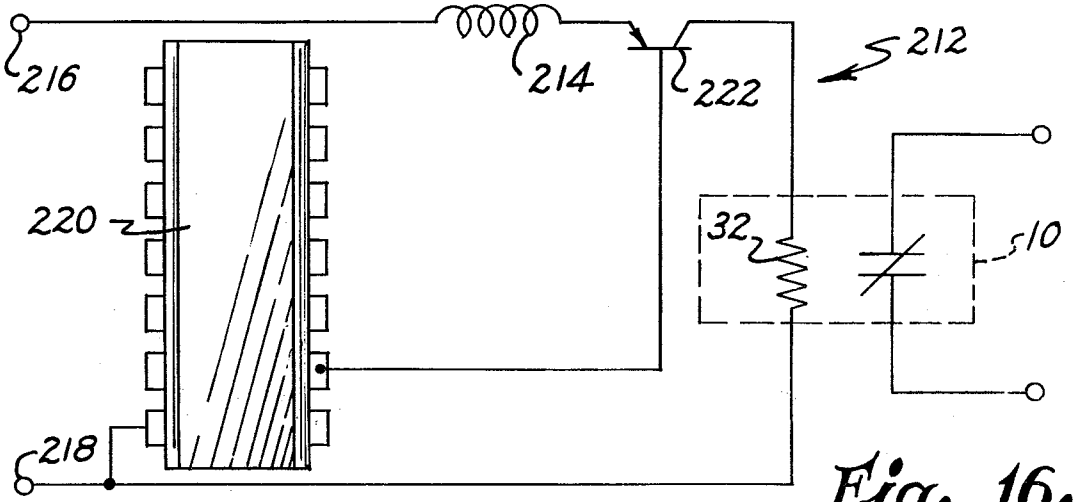
Figure 17:
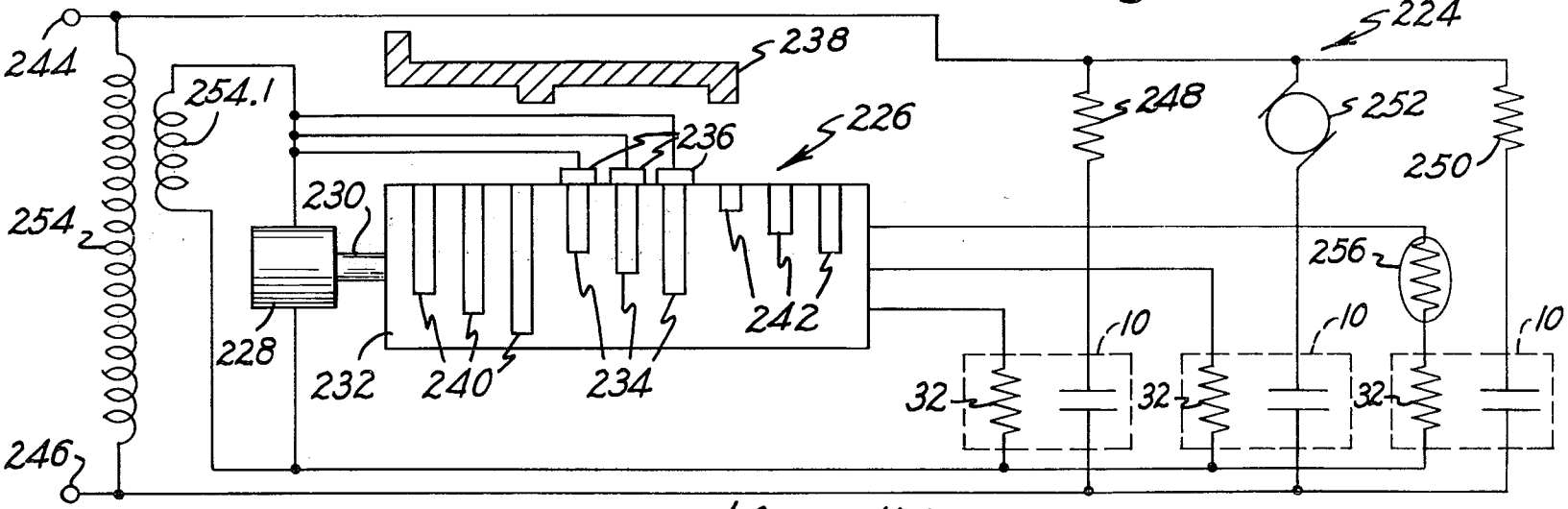

FIGS. 8—16 are schematic diagrams similar to FIG. 7 illustrating uses of relays of this invention in other alternate embodiments of relay systems of this invention; and FIG. 17 is a schematic diagram illustrating use of the relays of this invention in an appliance timer relay system.

Figure 1:
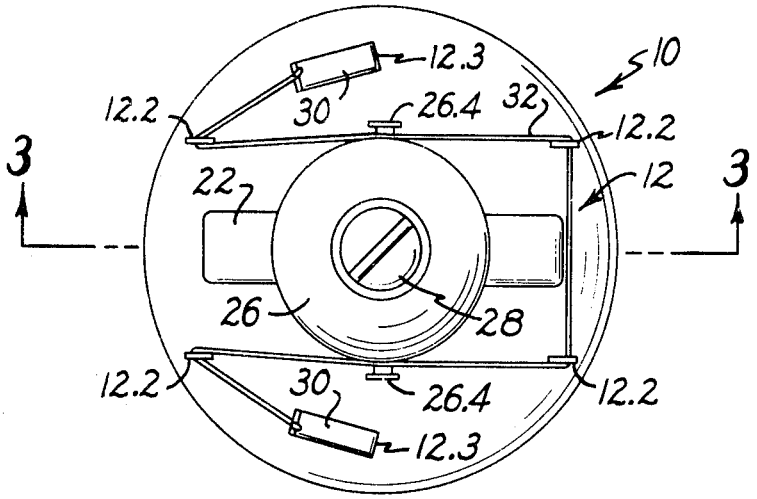
FIG. 1 is a plan view of a preferred embodiment of the high gain relay provided by this invention.
Figure 2:
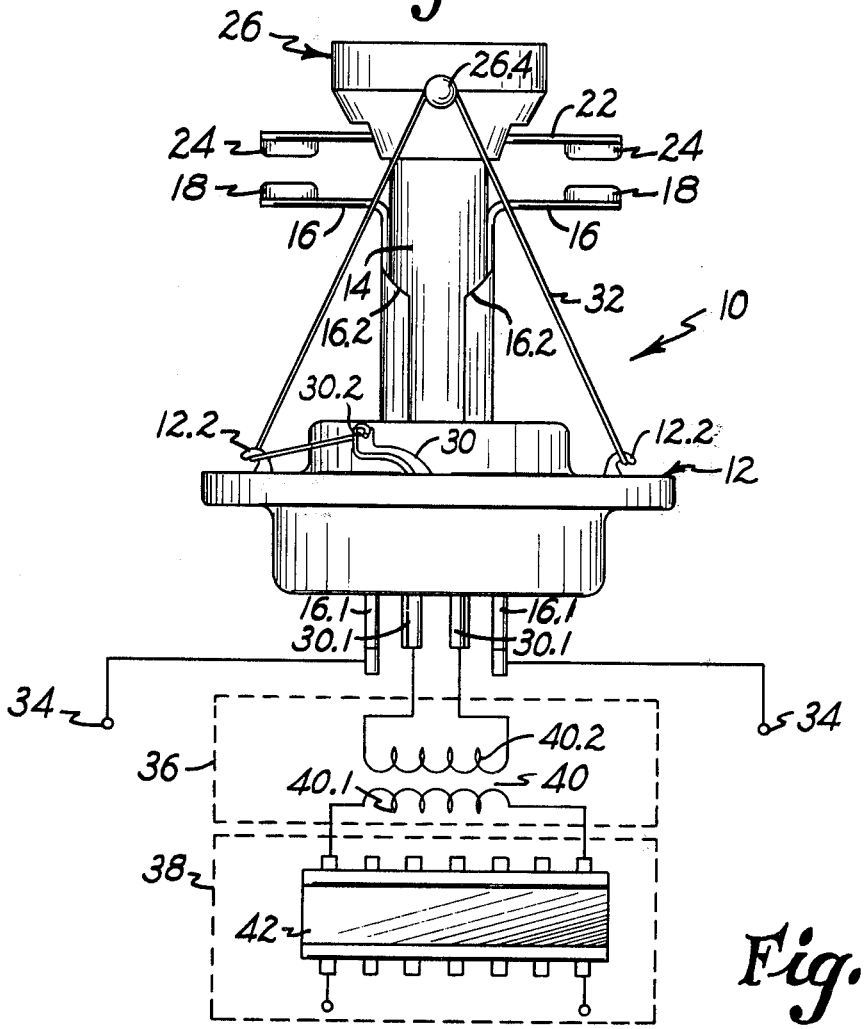
FIG. 2 is a side elevation view of the high gain relay shown in FIG. 1 and including diagrammatic illustration of use of the relay in a relay system.
Figure 3:
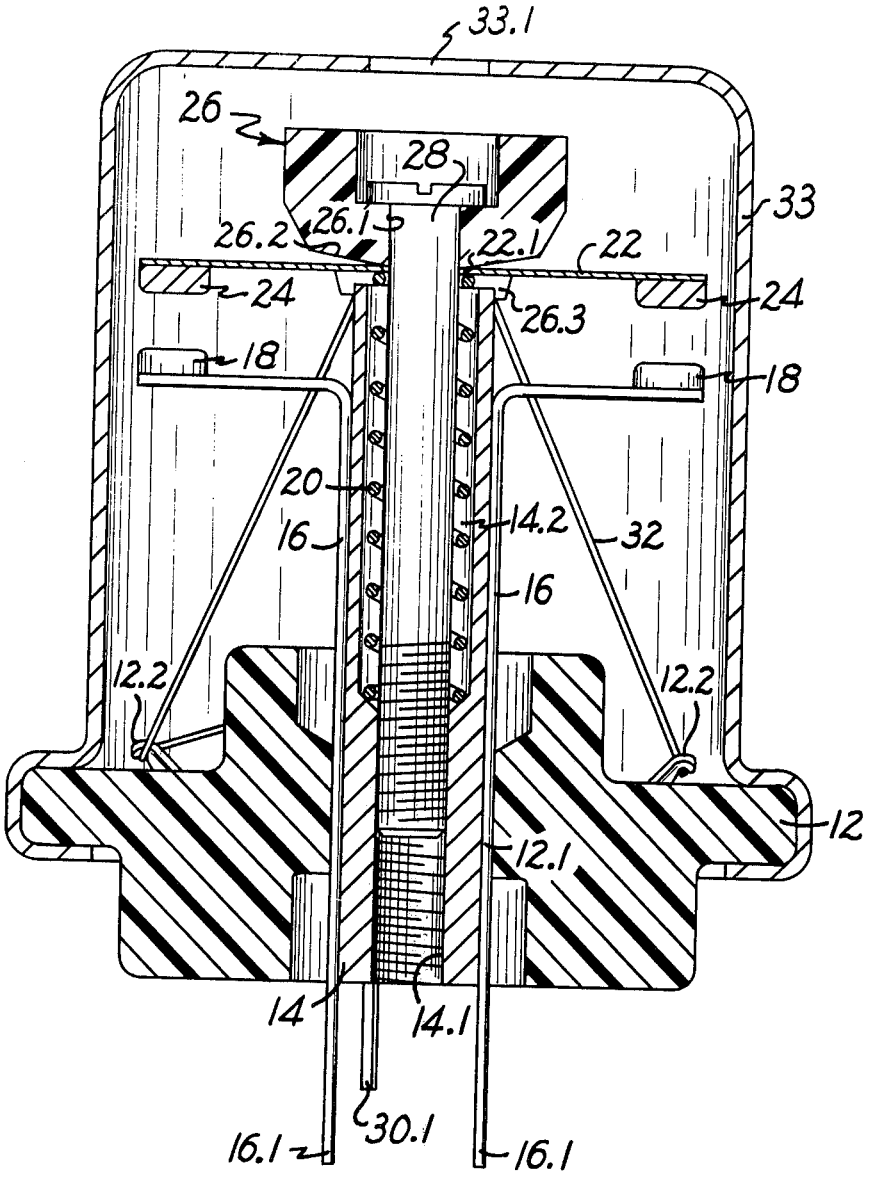
FIG. 3 is a section view along line 3—3 of FIG. 1.

Referring to FIGS. 1–3 of the drawings, a preferred embodiment of the high gain relay 10 of this invention is shown to include a base member 12 which is formed of a rigid, strong, electrically insulating material such as a molded phenolic resin and which has a central bore 12.1 extending through the base member. The base member is provided with four bosses 12.2 of hook-like configuration spaced on the upper surface of the base member as shown. An upstanding rod 14 of the same insulating material is then secured within the base member bore 12.1 in any conventional manner along with a pair of upstanding, L-shaped, electrically-conductive contact arms 16, each of which has a terminal portion 16.1 extending from the bottom of the base member and each of which extends upwardly to support a fixed contact 18 above the base member. Preferably, as indicated at 16.2 in FIG. 2, each of the contact arms 16 has wing portions fitted aground the rod 14 for securing the contact arms in spaced, electrically insulated relation to each other.

With the rod 14 internally threaded as indicated at 14.1 and provided with a counterbore 14.2, a helical coil compression spring 20 is fitted within the counterbore, and a movable, bridging contact arm 22 formed of electrically conductive material is disposed on top of the compression spring to support a pair of movable contacts 24 to be engaged and disengaged with respective fixed contacts 18. A relay cap member 26 of the previously noted insulating material is positioned as shown in the drawings to bear against the movable contact arm 22 and a threaded bolt 28 is fitted through an aperture 26.1 in the relay cap member and through an aperture 22.1 in the movable contact arm to extend through the counterbore 14.2 into threaded engagement with the rod 14.

The relay cap member 26 is also provided with a pair of bosses 26.4 disposed on opposite sides of the cap member. A pair of input or energizing terminals 30 are secured in any conventional manner within respective slots 12.3 in the relay base member. Each of the terminals 30 is formed of a stiff but deformable, electrically conductive metal material and is provided with a terminal portion 30.1 extending from the bottom of the relay base member and with a tank portion 30.2 extending above the base member. Both terminal portions 30.1 of the input terminals are shown in FIG. 2 for clarity of illustration. A thermally-responsive metal actuator wire 32 is then secured at one end to a tang 30.2 of one of the input terminals and is arranged to extend tautly over the bosses 12.2 on the relay base member and over the bosses 26.4 on the cap member as shown in FIG. 3 to be attached at its other end to the tang 30.2 of the other input terminal. Preferably, a metal relay cover 33 or the like (shown only in FIG. 2) having an adjusting aperture 33.1 is mounted on the relay base.

In the relay of this invention, the thermally-responsive wire 32 is formed of a mickel-titanium alloy commonly called Nitinol, the alloy preferably having a composition, by weight, of from about 54 to 56 percent nickel and the balance titanium. As is well known, this material is characterized in that, as the material is heated through a short transition temperature range, the material undergoes a crystalline transformation and displays a very sharp or abrupt change in physical properties including a very substantial increase in modulus of elasticity, these changes being reversible as the material is again cooled below its transition temperature range. When properly conditioned in well known manner, the material is also adapted to display remarkable shape memory properties as the material is heated through its transition temperature range. For example, when the alloy material of the wire 32 is deformed while below its transition temperature by drawing the wire to increase the wire length up to about 8 percent, the wire is adapted to subsequently display remarkable shape memory and to sharply shorten in length when the wire is thereafter heated above its transition temperature. After subsequent cooling of the wire below its transition temperature, the wire is again easily deformed by drawing or stretching to again prepare the wire for displaying its shape memory. Typically, for example, the wire 32 is formed of a nickel-titanium alloy comprising about 55 percent nickel, by weight, and the balance titanium, this alloy having a transition temperature at about 60°C. and having other physical properties as follows:

| | |
|---|---|
| Ultimate tensile strength | 125,000 psi |
| Density | 6.5 g./cc. |
| Heat capacity | 0.077 cal./degree C./g. |
| Resistivity | $80 \times 10^{-6}$ ohm-centimeters |
| Young's Modulus (below transition temperature | $3 \times 10^{-6}$ psi |
| Young's Modulus (above transition temperature) | $12 \times 10^{-6}$ psi |

In this arrangement of the relay 10 of this invention, the compression spring 20 is selected so that, with the material of the wire 32 below its transition temperature, the compression spring applies sufficient force to the wire to deform the wire to increase the wire length, preferably by at least about 4 percent, and to normally bias the movable contact arm 22 to the position shown in FIGS. 1–3 to hold the movable contacts 24 disengaged from the fixed contacts 18 of the relay. However, electrical current is adapted to be directed through the wire 32 between the input terminals 30 for electrically self-heating the material of wire 32 above its transition temperature so that the wire is sharply shortened in length and sharply increased in modulus of elasticity for moving the relay cap member 26 and the bridging contact arm 22 against the bias of the compression spring 20 to engage the movable contacts 24 with the fixed contacts 18 for closing a circuit between the fixed contacts. As will be understood, when the material of the wire 32 is thereafter permitted to cool below its transition temperature, whereby the modulus of elasticity of the wire material is returned to its low initial level, the compression spring 20 again deforms the wire 32 to increase the wire length and to return the bridging contact arm to its open circuit position as shown in FIGS. 1–3. The threaded bolt 28 is adjustable for varying the spacing between the movable and fixed contacts in the relay when the contact arm 22 is in open circuit position. The input terminals 30 are also adapted to be deformed for adjusting tension in the wire 32 for adjusting contact pressure between the fixed and movable contacts when the contact arm 22 is closed circuit position. Preferably the relay cap member 26 has sloping surfaces 26.2 and has flange portions 26.3 extending on either side of the contact arm 22 for assuring that the movable contact arm is maintained in proper alignment to bridge the fixed contacts 18.

In accordance with this invention, the mickel-titanium material of the wire 32 is adapted to display very high strength when the wire is above its transition temperature and, accordingly, the wire used in the relay 10 is of very small cross-sectional area on the order of $1.5 \times 10^{-5}$ square inches or less. On the other hand, the wire is provided with a relatively very long length. Typically, for example, the wire has a diameter of about 0.002 inches and a length of about 4 inches. In this arrangement, the material of the wire is adapted to be heated to its transition temperature with a very small input of electrical energy at low current levels and the wire is adapted to be heated to its transition temperature from a very low power source and, in preferred embodiments of this invention, the wire is proportioned as described so that the relays are operable at power levels of about 2 watts or less or even at about 0.5 watts or less. However, a number of lengths of the wire 32 are preferably arranged between the base and cap members of the relay so that, when the wire is heated to its transition temperature, substantial force is developed in the wire in the high strength state of the wire and a significant multiple of the force, at least about 15 grams and preferably on the order of 160 grams, is applied to the relay cap so that the relay contacts are held together with substantial contact pressure and are adapted to switch very substantial currents. In preferred embodiments of this invention, the relays of the invention are adapted to provide a gain of at least about 500 to 1 so that, although operable at the low power levels described above, are adapted to regulate operation of conventional components in various types of electrical apparatus. For example, where the alloy wire 32 has a diameter of 0.002 inches and a length of 4 inches as above described, the wire is adapted to be heated through its transition temperature in less than a second with 100 milliamperes of current at 5 volts whereas the relay 10 is adapted to switch 50 amperes at 120 volts between the terminals indicated at 34 in FIG. 2. As a result, the relay is adapted to be operated from low power sources such as are used in energizing conventional bipolar integrated circuits and, with suitable impedance matching, is adapted to be powered from sources used in energizing the very low powered MOS integrated circuits. However, the gain achieved by the relay is on the order of ten thousand-to-one and the relay is adapted to directly regulate operation of a variety of components used in various types of electrical apparatus.

Preferably, as is best illustrated in FIG. 2, the relay 10 of this invention is utilized in a relay system with impedance matching means 36 between the input terminals 30 of the relay and the relay energizing source 38.

For example, in a preferred embodiment of the invention, the impedance matching means 36 comprises a transformer 40 arranged with its secondary winding 40.2 connected across the relay input terminals and with its primary winding 40.1 connected to an alternating current, relay energizing, power source represented in FIG. 2 by the integrated ciruit device 42, (or to the power source used in energizing the intergrated circuit device), thereby to match the impedance of the integrated circuit to the wire 32 in the relay.

Figure 4:
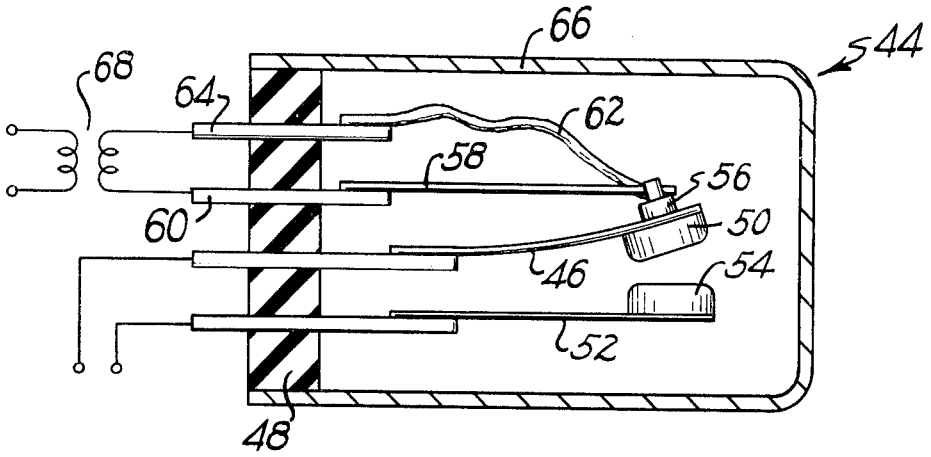
FIG. 4 is a section view along the central axis of another alternate embodiment of the relay of this invention.

Another preferred embodiment of the high gain power relay of this invention is illustrated at 44 in FIG. 4. This relay 44 includes a movable spring contact assembly 46 which is cantilever mounted at one end to an electrically insulating header 48 and which carries a movable relay contact 50 at its opposite end. The relay also includes a similarly mounted spring contact assembly 52 supporting a stationary contact 54 for engagement with the movable contact to close a relay output circuit. In accordance with this invention, an insulator 56 is also mounted at the distal end of the contact assembly 46 and a thermally-responsive actuator wire 58 is connected at one end to the insulator 56 and at its opposite end to an input or energizing terminal 60 mounted on the header 48. In addition, a flexible wire conductor 62 is connected to the actuator wire and to a second input terminal 64 as shown. The relay is then encased in an inert-gas-filled tube 66 hermetically sealed to the header, the input terminals 60 and 64 as well as terminal portions of the two spring contact assemblies also being hermetically sealed to the header in passing to the exterior through the header. In this arrangement, the input terminals and the wires 58 and 62 form a relay energizing circuit for receiving power from the secondary of an impedance matching transformer 68. The actuator wire used in the relay 44 has been conditioned to display characteristics similar to the wire 32 discussed with reference to FIGS. 1–3 and the transformer 68 allows direct interface of the relay energizing circuit with an alternating current, integrated circuit power output or the like as previously discussed.

In operation, the contact spring assembly 46 is normally biased for engaging the fixed and movable relay contacts while the material of the actuator wire 58 is below its transition temperature and unde stress applied by the spring assembly. However, when sufficient current appears at the secondary of the transformer, the wire 58 is heated to its transition temperature so that the wire abruptly shortens in length and pulls the contact assembly 46 upwardly to open the relay output circuit.

Figure 5:
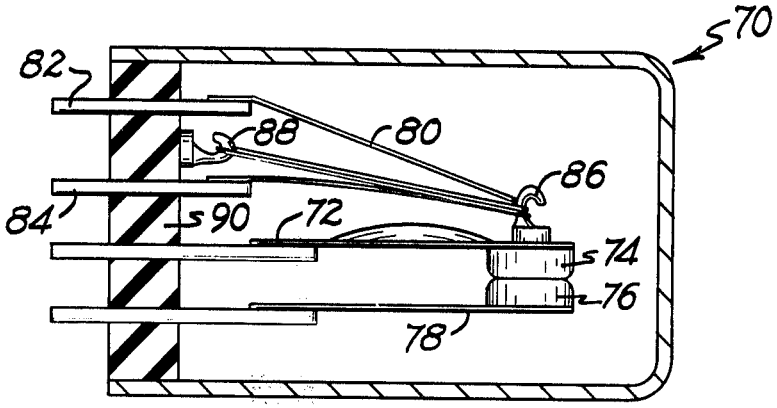
FIG. 5 is a section view similar to FIG. 4 illustrating another alternate embodiment of the relay of this invention.

Referring now to FIG. 5, another practical embodiment of the relay of this invention is illustrated at 70. In this relay, which is otherwise similar to the relay 44 previously described with reference to FIG. 4, the spring contact assembly 72 is formed in a monometallic snap-acting disc configuration so that, when the contact 74 carried by this spring assembly is disengaged and engaged with the stationary contact 76 carried by the other spring assembly 78, the contact separation or engagement occurs with improved snap-action. Further, the thermally responsive actuator wire 80 formed of the nickel-titanium alloy previously described is attached at one end to the input terminal 82 and at its opposite end to the input terminal 84, the wire extending from the input terminals through a hook-shaped insulator 86 on the spring assembly 72 and through a similar hook-shaped boss 88 mounted on the header 90. In this arrangement, the wire displays greater electrical resistance and is adapted to apply substantially greater force in moving the spring assembly 72 when the wire is heated to its transition temperature.

Figure 6:
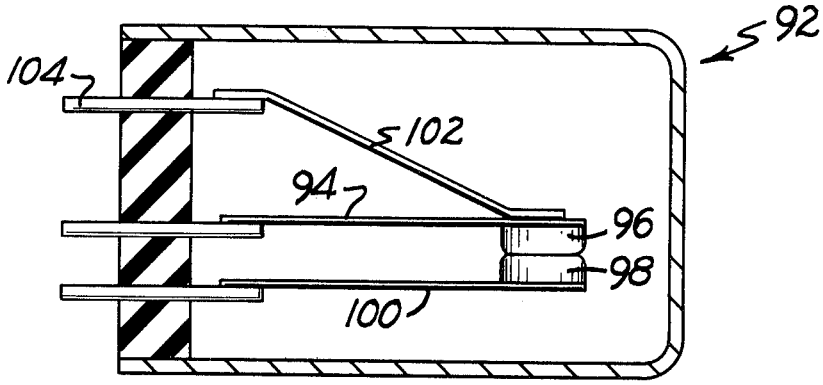
FIG. 6 is a section view similar to FIG. 4 illustrating another alternate embodiment of the relay of this invention.

In another embodiment of this invention illustrated at 92 in FIG. 6, a spring contact assembly 94 carrying a movable contact 96 for engagement with a stationary contact 98 carried by a second spring assembly 100 has its distal end secured in electrically conductive relation to a thermally-responsive actuator wire 102 of the noted nickel-titanium alloy, the opposite end of the actuator wire being attached to an input terminal 104. In this arrangement, current in the relay output circuit formed by the two contacts and spring assemblies is also directed through the actuator wire 102. As a result, when the wire is heated to the transition temperature of the wire material, the wire shortens in length to open the output circuit and to also deenergize the actuator wire. Upon cooling of the wire, the spring contact assemblies again closes both the relay output circuit and the circuit which heats the actuator wire.

The embodiment of this invention shown in FIG. 7 comprises a control system 106 for an electric blanket or the like utilizing a switching device 108 having a physical structure generally corresponding to the device 92 previously described with reference to FIG. 6 and utilizing current-regulating temperature-sensing elements that are particularly compatible with the switching device. As is diagrammatically illustrated in FIG. 7, the control 106 includes a variable resistor 110 and a resistance heater 112 arranged in series across terminals 114 and 116. The terminal 114 is also connected through the normally closed relay contacts 118 of the switching device 108 to the load 120. In addition, the thermally-responsive actuator wire 122 in the switching device 108 is arranged in series with a resistor 124 of negative temperature coefficient of resistivity (NTC) and with a resistor 126 of positive temperature coefficient of resistivity (PTC) as shown in FIG. 7, the NTC resistor being disposed in heat-transfer to the load 120 as indicated by the broken line 128 and the PTC resistor being in heat-transfer relation to the resistance heater 112 as indicated by the broken line 130.

In this arrangement, application of a voltage across the terminals 114 and 116 energizes the load 120 through the normally closed relay contacts 118 and energizes the resistance heater 112 in accordance with the setting of the variable resistor 110, the NTC resistor normally preventing sufficient current flow in the actuator wire 122 of the switching device. Then, the NTC resistor becomes heated as heat is generated by the load 120, and lowers in resistance, whereby the actuator wire 122 is heated to its transition temperature for opening the relay contacts to deenergize the load 120. After a cooling period, the NTC resistor increases in resistance to again reduce current in the actuator wire 122 until the relay contacts again close as will be understood. As will also be understood, adjustment of the variable resistor 110 adjusts heating of the resistance heater 112 which through heat-transfer to the PTC resistor 126 adjusts the cycling rate of control system 106.

Figure 8:
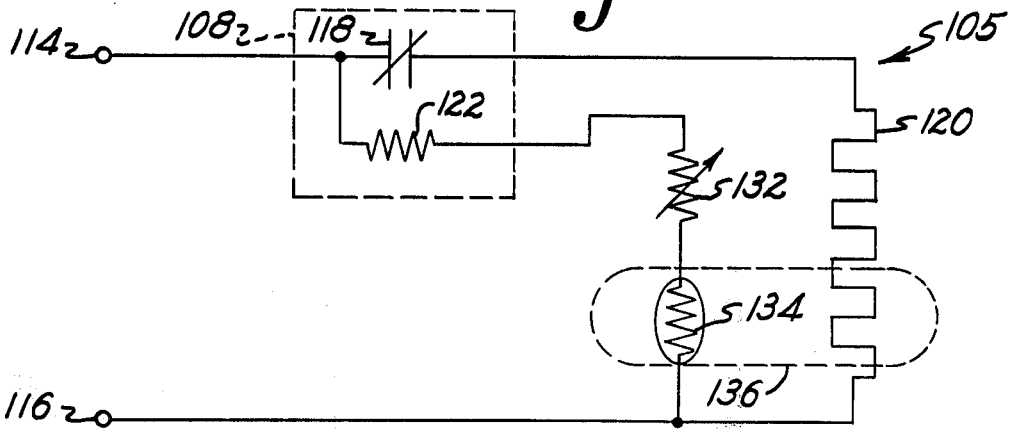

Referring now to FIG. 8, there is shown a second embodiment 105 of a control device similar to the device as set forth in FIG. 7, corresponding elements being identified by the reference numerals used ith regard to FIG. 7. Here again the switch 108 is normally closed and supplies current to load 120. Current also passes through the series circuit of actuator wire 122, variable resistor 132 and NTC resistor 134. As the load 120 heats up it heats up NTC resistor 134 as indicated by the broken lines 136, thereby increasing the current through wire 122 until the wire lengthens and opens switch contacts 118. Cooling of load 120 reverses the cycle. The point at which switch 108 opens and closes is determined by the setting of variable resistor 132. This embodiment of the invention could be utilized, for example, as a fry pan control.

Figure 9:
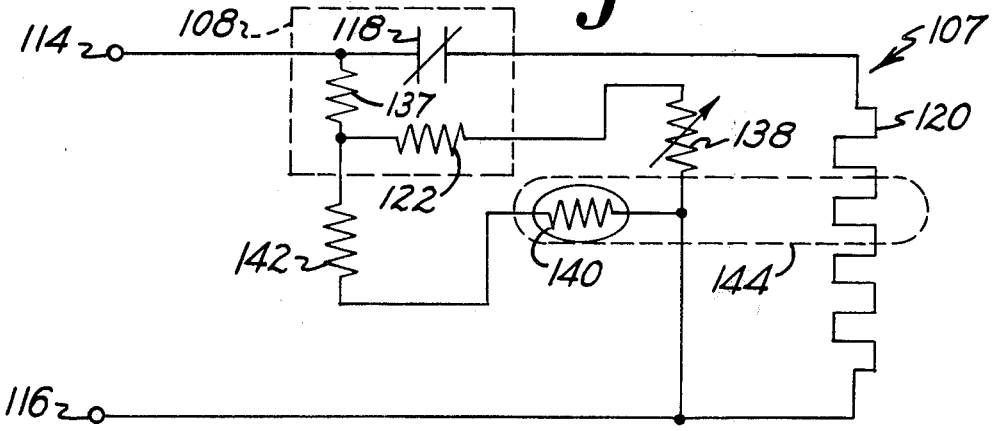

Referring now to FIG. 9, there is shown a third embodiment 107 of a control device similar to the devices as set forth in FIGS. 7 and 8. Here again the switch 108 is normally closed. Current therefore passes through switch 108 and load 120 and through the series circuit of actuator wire 122, the additional series resistor 137 incorporated in the switch 108, and variable resistor 138 as well as through PTC resistor 140 and the resistor 142. When the temperature at the load increases, it heats resistor 140 as indicated at 144, thereby increasing the resistance and passing less current through the PTC resistor. This causes more current to pass through wire 122 until the wire shortens and opens switch contacts 118. As the load 120 cools, the resistance of PTC resistor 140 decreases and diminishes the current passing through wire 122 so that the wire cools to the temperature where it lengthens and allows closing of the switch contacts 118. The setting of variable resistor 138 determines the temperature of operation of the switch 108. This embodiment of this invention could be used in an oven control.

Figure 10:
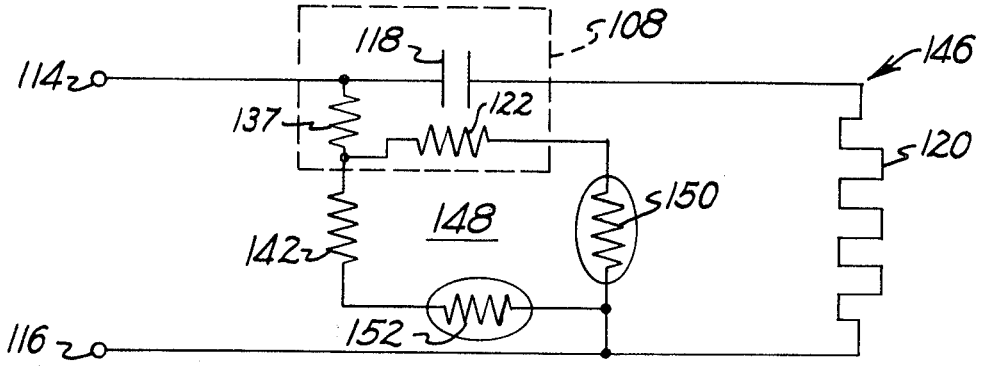

Referring now to FIG. 10, there is shown a fourth embodiment 146 of a control device similar to the devices as set forth in FIGS. 7 to 9. Here the switch 108 incorporating the additional resistor 137 is normally open. In the device, as the temperature of a compartment indicated at 148 decreases, the resistance of the PTC resistor 150 decreases while the resistance of the NTC resistor 152 increases. This causes more current to pass through the actuator wire 122 and, upon reaching the transition temperature, closes the switch contacts 118 and connects power to the load 120. Increase of temperature now causes more current to be shunted through resistor 142 and NTC resistor 152 and less current through resistor 150, thereby causing the switch 108 to open due to lengthening of wire 122. A device of this type has application as a refrigerator defrost control wherein buildup of ice causes the switch 108 to close and connect power to a heater, thereby allowing the refrigerator to defrost until sufficient frost is removed from the refrigerator to alter the cooling rate of resistors 150 and 152 and thus to change the cycle.

Figure 11:
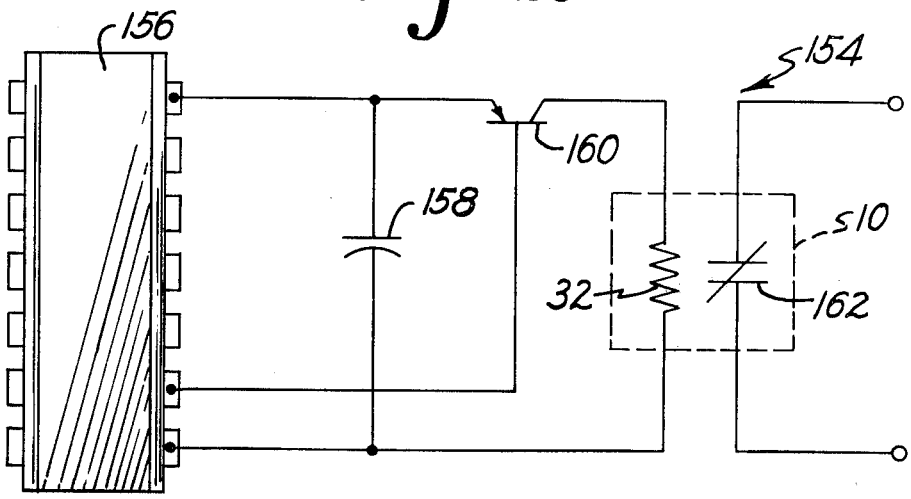

Referring now to FIG. 11, there is set forth a circuit system 154 for utilizing a low power relay such as the relay 10 previously described with references to FIGS. 1–3 with a high voltage-low current source such as an MOS type of integrated circuit device 156 without requiring use of a transformer.

In accordance with this embodiment of this invention, the MOS integrated circuit device 156, which typically has an output of about 3 milliamps at 30 volts, is arranged to charge the capacitor 158 in about 60 milliseconds, for example, while the MOS integrated circuit device is arranged to apply a control pulse to the transistor 160 after the capacitor is charged for discharging the capacitor 158 through the actuator wire 32 of the relay 10 previously described. In this arrangement, the current directed through the wire 32 at 30 volts during capacitor discharge is adequate to heat the wire to its transition temperature for opening the contacts of the relay as indicated at 162. The relay may then be latched open in any conventional manner, or, if desired, the control pulss are applied to the transistor 160 by the integrated circuit device at selected intervals for providing the relay with a selected duty cycle as will be understood. In this arrangement, the very low power MOS type of integrated circuit is arranged to operate the low power high gain relay of this invention.

Figure 12:
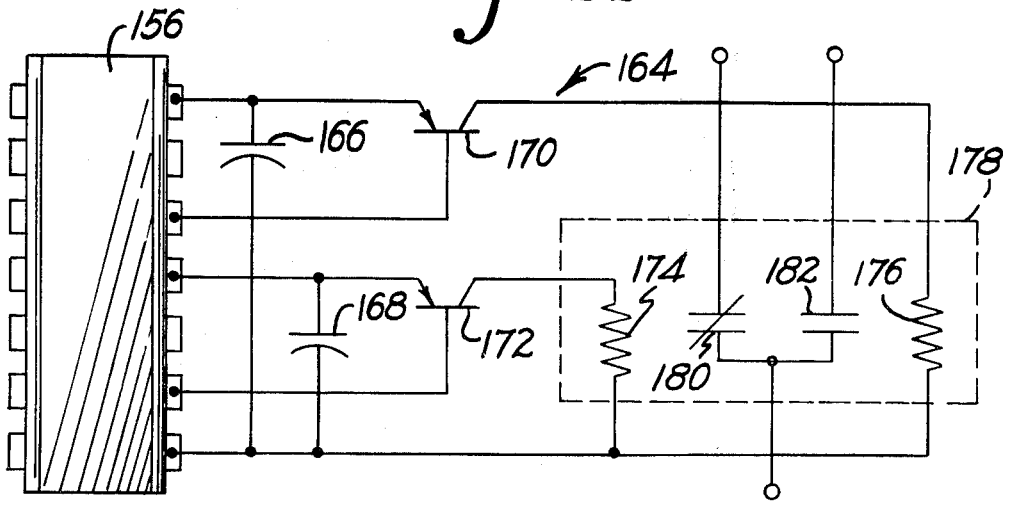

Referring now to FIG. 12, there is set forth another alternate embodiment 164 of this invention similar to the circuit system 154 described above. In this embodiment 164 of this invention, the MOS integrated circuit device 156 is arranged as shown in FIG. 12 to charge capacitors 166 and 168 while also being adapted to periodically apply control pulses to the transistor 170 and to the transistor 172 for periodically rendering the transistors conductive to discharge the capacitors through respective actuator wires 174 and 176 in a relay 178. In this embodiment of this invention, the relay 178 comprises a single-pole, double-throw latching type of relay otherwise similar to the relays of this invention as previously described, having any conventional means releasably retaining the relay contacts in either of its two stable positions. That is, the relay 178 typically has one pair of relay contacts 180 which are normally closed and another pair of normally open relay contacts 182. In this arrangement of system 164, electrical energy accumulated in the capacitor 166 is periodically applied to an actuator wire 174 in the relay 178 in response to a control pulse from the integrated circuit device 156 for opening the relay contacts 180 and closing the relay contacts 182 for moving the relay from one of its stable positions to its second stable position as will be understood. A subsequent control pulse from the integrated circuit device is then adapted to discharge the capacitor 168 through the other actuator wire 176 in the relay for returning the relay to its original stable position.

Figure 13:
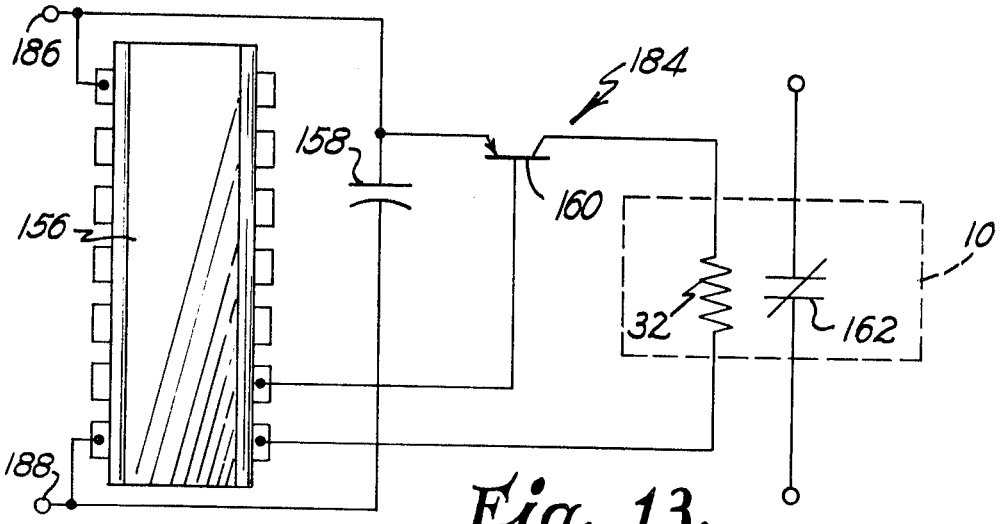

In another alternate embodiment of this invention illustrated in FIG. 13, the circuit system 184 is generally similar to the circuit system 154 except that the capacitor 158 is charged from the power source, indicated by terminals 186 and 188 in FIG. 13, used in energizing the integrated circuit device 156.

Figure 14:
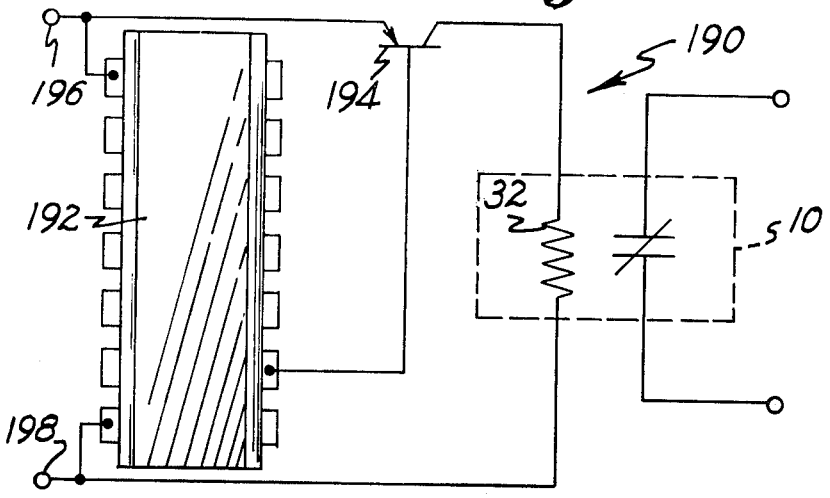

In another alternate embodiment of the circuit system of this invention, as illustrated at 190 in FIG. 14, a relay 10 such as has been previously described with reference to FIGS. 1–3, and which is preferably energized from a 6 volt source, is arranged to be operated from a 30 volt power source or the like such as is used in energizing the MOS integrated circuit device for operating the relay without excessive power loss. In this arrangement, the integrated circuit device 192 is adapted in any conventional manner to provide a series of control pulses to the transistor 194 so that current from the 30 volt power source or the like indicated by the line terminals 196 and 198 is rapidly switched on and off to provide an effective (rms.) voltage of about 6 volts to the wire 32 in the relay 10 for heating the wire to its transition temperature for opening the relay contacts. While this circuit system is adapted for use with various line voltages, greatest economy and efficiency is achieved where the line voltage is on the order of 24 to 30 volts.

In another alternate embodiment of this invention as indicated at 200 in FIG. 15, the circuit system is arranged to match the impedance of a higher voltage power source such as a 110 volt a.c. line as indicated by the terminals 202 and 203 to the relay 10 by phase modulation. That is, the MOS integrated circuit device 204 is arranged to be energized from a 30 volt a.c. power source indicated by the terminals 206 and 208 which is synchronized with the 110 volt source, the integrated circuit device being adapted in any conventional manner to apply gating pulses to the SCR 210 only as the alternating line voltage and current approach zero, thereby to reduce the rms voltage applied to the actuator wire 32 in the relay 10 to about one-fifth of line voltage as required for heating the wire 32 to its transition temperature for opening the contacts of the relay 10. In this arrangement, a relatively inexpensive circuit component 210 is adapted to be used even though the relay is being impedance matched to a 110 volt line. As will be understood, a triac can be substituted for the SCR 210 for providing operation during both halves of the circuit cycle.

In another alternate embodiment of this invention as illustrated at 212 in FIG. 16, the relay 10 of this invention is impedance matched to a d.c. power source by use of an inductance coil 214. That is, as is shown in FIG. 16, an inductance coil 214 is arranged in series with the actuator wire 32 of the relay 10 and with a 30 volt d.c. power source or the like indicated by the terminals 216 and 218 whereas an MOS integrated circuit device 220 is adapted in any conventional manner to apply brief control pulses to the transistor 222 for periodically rendering the transistor conductive. In this arrangement, the inductive coil is selected to provide a selected phase relationship as the transistor is being briefly rendered conductive, thereby to apply significantly less than peak line current and voltage to the actuator wire 32 as required for heating the wire to its transition temperature for opening the contacts of the relay 10.

In another embodiment of this invention indicated at 224 in FIG. 17, the high gain relays 10 of this invention as previously described are arranged for use with a low voltage, low power appliance timer 226 of otherwise conventional design, whereby the timer contacts are adapted to be of very light construction while displaying a long service life. That is, as is shown in FIG. 17, a low voltage low power appliance timer of conventional design is shown to include a synchronous motor 228 which rotates a drum 232 on a shaft 230 so that timer contacts 234 disposed at different locations on the surface of the drum 232 are sequentially engaged with respective wiping contacts 236. As will be understood, a slide 238 is typically arranged for moving the wiping contacts 236 to engage other sets of timer contacts 240 or 242 for changing the program provied by the drum. As will be understood, a 110 bolt a.c. power supply indicated by the terminals 244 and 246 is arranged to energize various electrical components such as the solenoids 248, 250 and the motor 252 through contacts of the respective relays 10.

In accordance with this invention, a transformer 254 is connected across the line terminals and the transformer secondary 254.1 is arranged to energize a timer motor 228 at 12 volts for example. The actuator wires 32 of the relays 10 are then arranged to be sequentially connected to the transformer secondary through the timer drum contacts 234 and the wiping contacts 236 as the timer drum is rotated as will be understood. In this way, using the high gain relays 10 of this invention, it is possible to utilize a low voltage low power timer mechanism 226 which can be of very light construction in sequentially operating a variety of electrical components such as the solenoids 248, 250 and the motor 252. Where desired, a resistor 256 of negative temperature coefficient of resistivity is arranged in series with the wire 32 to serve as a limit control.

It should be understood that although various embodiments of this invention have been described above by way of illustration, this invention includes all modifications and equivalents of the described embodiments falling within the scope of the appended claims.

We claim:

1. A relay system comprising a relay operable at the low power levels used in energizing integrated circuits having an insulating base, stationary contact means mounted on said base, movable contact means mounted on said base for movement between a closed circuit position engaging said stationary contact means and an open circuit position spaced from said stationary contact means, spring means mounted on said base biasing said movable contact means from one of said positions to the other of said positions, and a metal wire secured between said movable contact means and said base, said wire being of a selected nickel-titanium alloy to be deformed from an original length to a second length by said spring bias as said movable contact means is moved from said one position to said other position by said spring bias while said alloy displays a relatively low modulus of elasticity below a transition temperature and to abruptly return to said original length and to display a relatively higher modulus of elasticity to move said movable contact means back to said one position against said spring bias with a force of at least about 15 grams when said wire is heated to said transition temperature, said wire having a selected cross-sectional size corresponding to a diameter of less than about 0.004 inches and a selected length to be heated from room temperature to said transition temperature by passing electrical current through said wire with a power input of less than about 2 watts for permitting operation of said relay with a gain of at least about 500 to 1 at power levels used in energizing integrated circuits; integrated circuit means energizable at low power levels to supply a control pulse; a power source for energizing said integrated circuit means to supply said control pulse; transistor switch means connected in series with said relay wire to direct relay energizing current from said power source through said nickel-titanium wire when said transistor switch means is rendered conductive, said transistor switch means being connected to said integrated circuit means for receiving said control pulse to selectively render said transistor switch means conductive for operating said relay.

2. A relay system as set forth in claim 1 wherein said transistor switch means is connected in series between said relay wire and said integrated circuit means.

3. A relay system as set forth in claim 1 wherein said transistor switch means is connected in series between said relay wire and said power source.

4. A relay system as set forth in claim 1 wherein capacitor means are arranged to receive charging current from said power source in said transistor switch means is connected in series between said capacitor means and said relay wire for selectively discharging said capacitor means through said relay wire when said transistor switch means is rendered conductive.

5. A relay system as set forth in claim 4 wherein said capacitor means is arranged to be charged directly from said power source.

6. A relay system as set forth in claim 1 having said capacitor means arranged to be charged from said intergrated circuit means.

7. A relay system as set forth in claim 1 wherein said power source comprises a d.c. power source and wherein an inductance coil means is disposed in series with said transistor switch means between said relay wire and said power source, said control pulse applied to said transistor switch means being adapted to render said transistor switch means conductive intermittently for effectively matching the impedance of said power source and said relay wire.

8. A relay system comprising a relay operable at the low power levels used in energizing integrated circuits, said relay having an electrically insulating base, a pair of stationary contact means mounted on said base, movable contact means movable between a position engaging one of said stationary contacts and a position engaging the other of said stationary contacts, means releasably latching said movable contact means in either of said positions, a pair of wires of a selected nickel-titanium alloy secured between said base and said movable contact means, each of said wires being adapted to be deformed from an original length to a greater length as said movable contact means is moved from one of said positions to the other of said positions by the other wire while said alloy displays a relatively low modulus of elasticity below a transition temperature and to abruptly return to said original length and to display a relatively higher modulus of elasticity to return said movable contact means to said one position with a force of at least about 15 grams when said wire is heated to said transition temperature, each of said wires having a selected cross-sectional size corresponding to a diameter of less than about 0.004 inches and a selected length to be heated from room temperature to said transition temperature by passing electrical current through said wire with a power input of less than about 2 watts for permitting operation of said relay with a gain of at least about 500 to 1 at power levels used in energizing integrated circuits; integrated circuit means energizable at low power levels to alternatively supply a pair of control pulses; a power source for energizing said integrated circuit means to alternately supply said pair of control pulses; a pair of capacitors arranged to be charged from said integrated circuit means; and a pair of transistors connected in series between respective capacitors and said respective relay wires for discharging said capacitors through said wires when said transitors are rendered conductive, said transistors being connected to said integrated circuit means for receiving respective control pulses for operating said relay.

9. A relay system comprising a relay operable at the low power levels used in energizing integrated circuits having an insulating base, stationary contact means mounted on said base, movable contact means mounted on said base for movement between a closed circuit position engaging said stationary contact means and an open circuit position spaced from said stationary contact means, spring means mounted on said base biasing said movable contact means from one of said positions to the other of said positions, and a metal wire secured between said movable contact means and said base, said wire being of a selected nickel-titanium alloy to be deformed from an original length to a second length by said spring bias as said movable contact means is moved from said one position to said other position by said spring bias while said alloy displays a relatively low modulus of elasticity below a transition temperature and to abruptly return to said original length and to display a relatively higher modulus of elasticity to move said movable contact means back to said one position against said spring bias with a force of at least about 15 grams when said wire is heated to said transition temperature, said wire having a selected cross-sectional size corresponding to a diameter of less than about 0.004 inches and a selected length to be heated from room temperature to said transition temperature by passing electrical current through said wire with a power input of less than about 2 watts for permitting operation of said relay with a gain of at least about 500 to 1 at power levels used in energizing integrated circuits; integrated circuit means energizable at low power levels to supply a control pulse; a first alternating current power source; a gated semiconductive device connecting said first power source to said relay wire for directing relay energizing current from said first power source through said relay wire when said semiconductive device is rendered conductive; a second alternating current power source for energizing said integrated circuit means to supply said control pulse, said second power source being synchronous with said first power source; and means for applying said control pulse to said semiconductive device for rendering said device conductive during a selected part of each alternating current cycle for said power sources for matching the impedance of said first power source to said relay wire.

10. A relay system as set forth in claim 9 wherein said semiconductive device comprises an SCR.

11. A relay system as set forth in claim 9 wherein said semiconductive device comprises a triac.

* * * * *